United States Patent [19]

Ader

[11] Patent Number: 4,561,351

[45] Date of Patent: Dec. 31, 1985

[54] IMPLEMENT FOR FLATTENING CYLINDRICALLY SHAPED CONTAINERS

[76] Inventor: Vern L. Ader, 9352 Eisenhower, Marshfield, Wis. 54449

[21] Appl. No.: 600,119

[22] Filed: Apr. 13, 1984

Related U.S. Application Data

[63] Continuation-in-part of Ser. No. 443,537, Jan. 18, 1983, abandoned.

[51] Int. Cl.[4] ..... B30B 9/32

[52] U.S. Cl. ..... 100/233; 100/293; 100/295; 100/902

[58] Field of Search ..... 100/902, 233, 295, 293; 241/99; D15/123

[56] References Cited

U.S. PATENT DOCUMENTS

| | | | |
|---|---|---|---|
| 2,603,270 | 7/1952 | Voigt et al. | 153/10.5 |
| 2,773,536 | 12/1956 | Lange | 153/10.5 |
| 3,048,096 | 8/1962 | Guedel | 100/215 |
| 3,079,856 | 3/1963 | Swartz | 100/50 |
| 3,204,550 | 9/1965 | Swiderski et al. | 100/52 |
| 3,667,386 | 6/1972 | Workman | 100/902 X |
| 3,766,849 | 10/1973 | Maron | 100/902 X |
| 3,776,129 | 12/1973 | Carlson | 100/902 X |
| 3,853,054 | 12/1974 | Jacobsen | 100/902 X |
| 3,980,015 | 9/1976 | Woodard | 100/902 X |
| 3,988,978 | 11/1976 | Flick | 100/35 |
| 4,143,595 | 3/1979 | Carlson | 100/280 |
| 4,212,242 | 7/1980 | Willis | 100/233 |
| 4,228,734 | 10/1980 | Parrish | 100/245 |
| 4,235,164 | 11/1980 | Allen et al. | 100/53 |
| 4,292,891 | 10/1981 | Shelley | 100/902 X |
| 4,333,397 | 6/1982 | Modes | 100/902 X |
| 4,383,480 | 5/1983 | Jordon | 100/96 |
| 4,393,765 | 7/1983 | Accettura | 100/902 X |

*Primary Examiner*—Billy J. Wilhite

*Attorney, Agent, or Firm*—Kinney & Lange

[57] ABSTRACT

A one-step, manually operated apparatus for one-handed flattening and folding of cylindrical crushable containers, so as to enable them to be stored in a smaller space when they are in their normal dimensions, and to flatten them in a manner that the vendor identification marks are readily discernible after flattening.

11 Claims, 5 Drawing Figures

Fig. 1
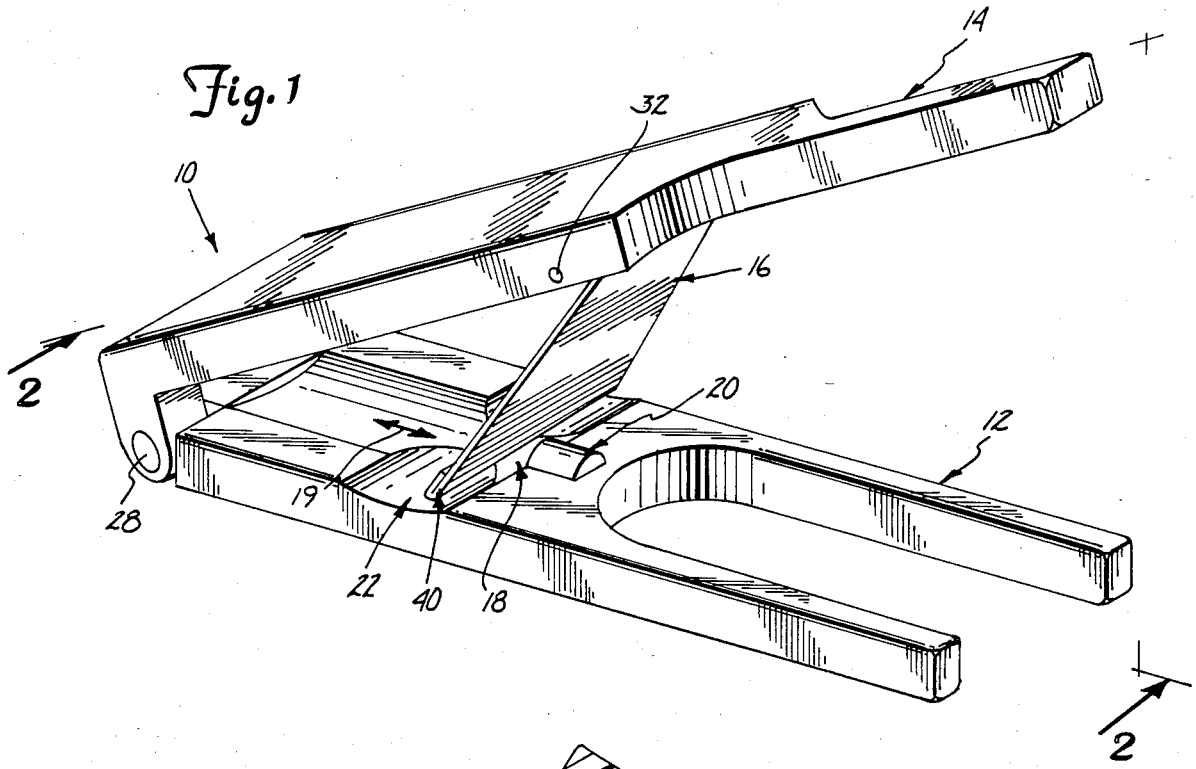
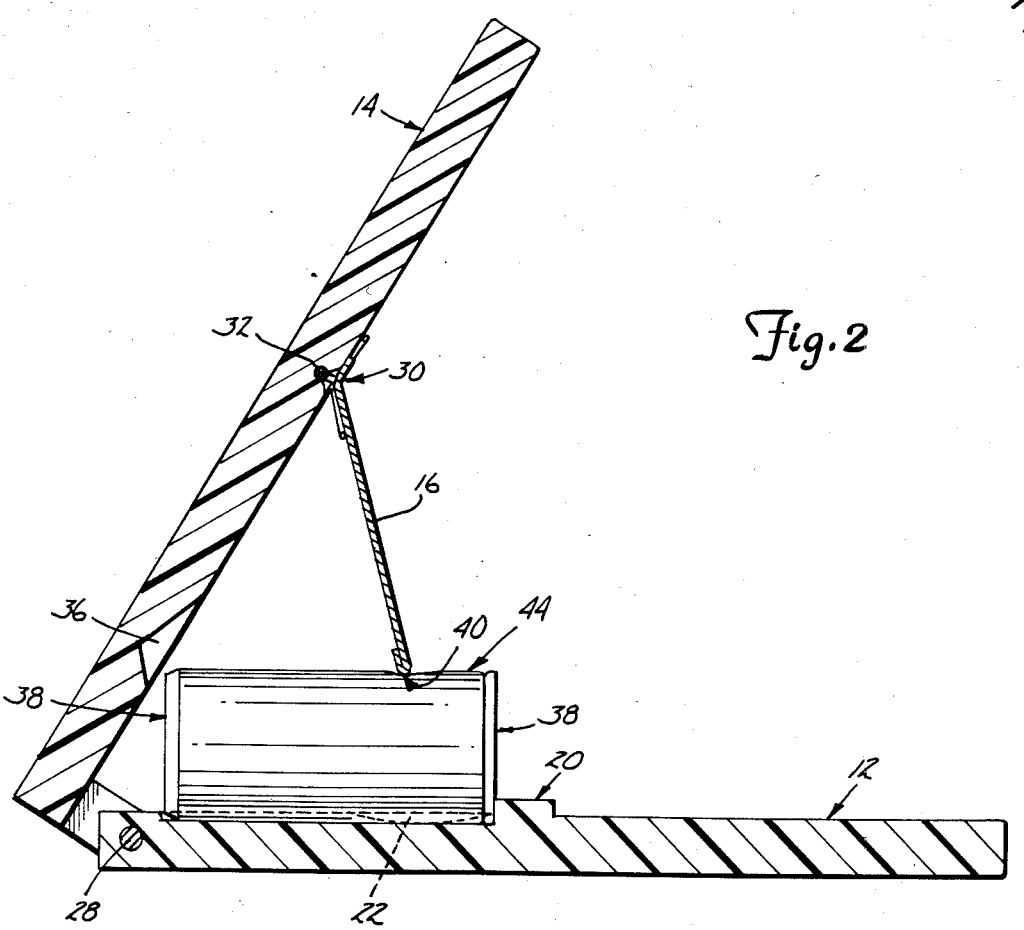
Fig. 2

Fig.3
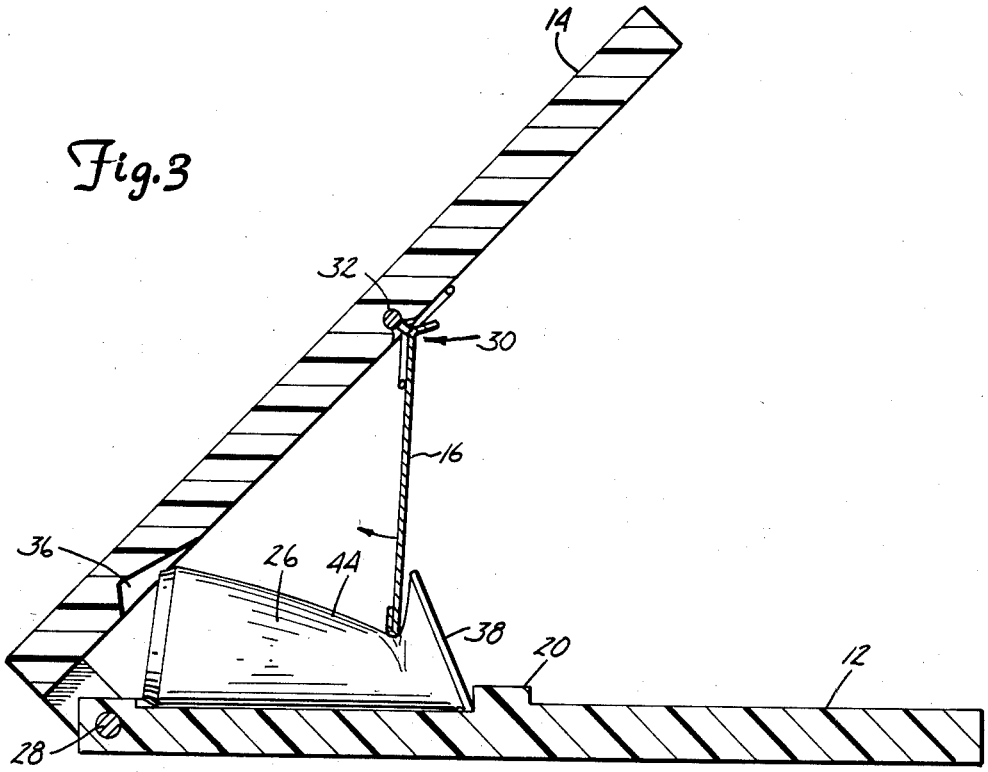
Fig.4
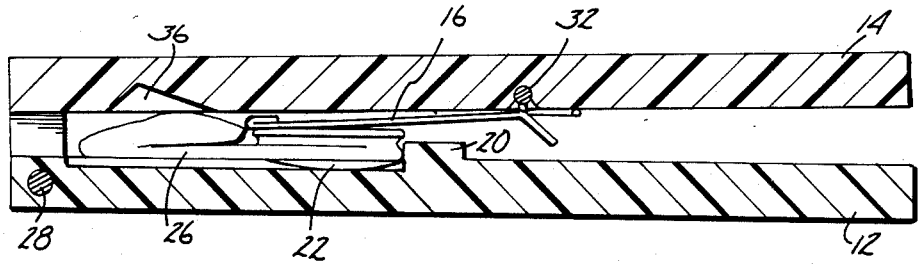
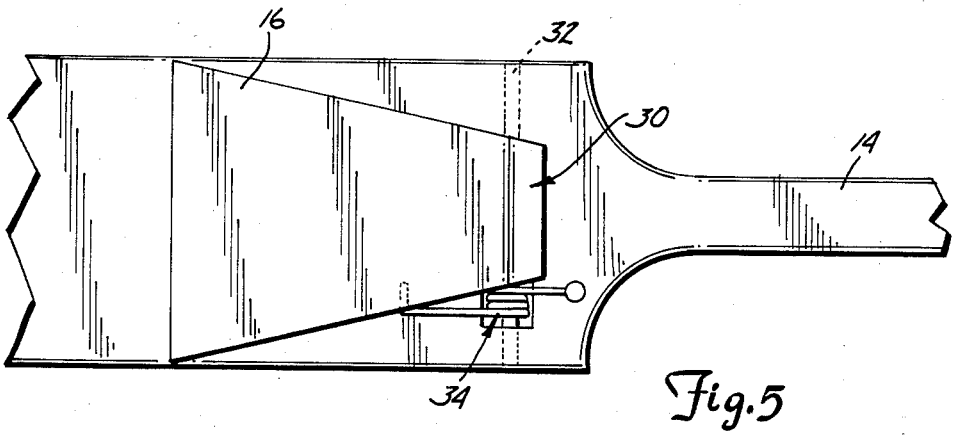
Fig.5

IMPLEMENT FOR FLATTENING CYLINDRICALLY SHAPED CONTAINERS

BACKGROUND OF THE INVENTION

This application is a continuation-in-part application of Ser. No. 06/443,537, filed Jan. 18, 1983, entitled "Aluminum Can Crusher", now abandoned.

1. Field of the Invention

The present invention relates generally to the field of cylindrical container flattening devices and specifically to a cylindrical container flattening device which flattens the container in a manner that the vendor labels or identification marks on the sides of the container are readily discernible.

Because of the increased recycling of used aluminum beverage containers in recent years, and because of the bulk of the containers, small, hand operated mechanical devices for flattening the containers and reducing their size and volume for storage purposes are desirable.

2. Description of the Prior Art

Prior art apparatus, although performing the function of flattening containers, has not provided apparatus for one step, one hand, manual flattening which leaves the vendor labels on the side of the container exposed for later identification.

Two step apparatus used to flatten cylindrical containers are shown in Modes U.S. Pat. No. 4,333,397, Workman U.S. Pat. No. 3,667,386, Shelley U.S. Pat. No. 4,292,891, Woodard U.S. Pat. No. 3,980,015, Jacobsen U.S. Pat. No. 3,853,054, Maron U.S. Pat. No. 3,766,849, and Jordon U.S. Pat. No. 4,383,480.

Flick U.S. Pat. No. 3,988,978 requires an operator to use both his hands and his feet to crush the container by a vertical motion downward upon the container.

Although Accettura et al. U.S. Pat. No. 4,393,765 discloses two embodiments of a one step flattener, neither embodiment both crushes a container and leaves the vendor's labels easily identifiable. The embodiment providing the better vendor identification requires that the container be forced onto an upward protruding spike to fixedly secure the container in place before crushing.

Carlson U.S. Pat. No. 3,776,129 and Voight U.S. Pat. No. 2,603,270 are one step can crushers which provide poor vendor label identification.

Parrish U.S. Pat. No. 4,228,734, Carlson U.S. Pat. No. 4,143,595, Swiderski et al. U.S. Pat. No. 3,204,550, Schwartz U.S. Pat. No. 3,079,856, Guedel U.S. Pat. No. 3,048,096 and Lange U.S. Pat. No.2,773,536, all apply force to the ends of the container, perpendicular to the longitudinal axis thereof, thereby crushing the container ends together into a "hockey puck" end product. Vendor identification is extremely difficult to discern on containers crushed using these devices and the cans will actually be refused for deposit refunds by many beverage distributors.

Willis U.S. Pat. No. 4,212,242 applies force to the ends of the container to rotate the ends inward over the center of the container. This multi-lever apparatus provides poor mechanical leverage in that the apparatus does not have a means for buckling the container sides inward or outward before the ends of the container are rotated over the center of the container, and therefore requires a great deal of force to crush a can.

SUMMARY OF THE INVENTION

The present invention includes a one-step, one hand, manual apparatus for flattening and folding cylindrical crushable containers, so as to enable them to be stored in a smaller space than is required for uncrushed containers, and to flatten them in a manner that the vendor labels on the sides of the container are readily discernible after flattening. The apparatus is compact, lightweight and operates simply using a modest force applied with one hand. A unique arrangement provides for the crushing of the side wall to weaken it prior to folding the ends inwardly as a part of a coordinated one-step process.

The apparatus comprises a frame mechanism constructed and arranged to retain a container on a first end thereof, the longitudinal axis of the container being aligned with the longitudinal axis of the frame mechanism.

A handle mechanism is pivotally connected to the first end of the frame mechanism for rotation from an opened position angled by an acute angle to the longitudinal axis of the frame mechanism, to a closed position generally parallel to the frame mechanism and displaced therefrom by a distance substantially less than the diameter of the cylindrically shaped container to be flattened.

A pivot plate mechanism is pivotally mounted by a first or fixed end to the handle mechanism, at a longitudinally intermediate position thereon, for rotation from a first position acutely angled with respect to the longitudinal axis of the handle mechanism and substantially perpendicular to the frame mechanism when the handle mechanism is in an opened position, to a second position substantially flush with the handle mechanism when the handle mechanism is rotated to its closed position. The pivot plate mechanism is constructed and arranged in its first position for engagement with a side wall of a cylindrical container retained on the frame means. As the handle mechanism is rotated from it's opened position to its closed position, urging the pivot plate mechanism from its first position to its second position, the free end of the pivot plate mechanism is directed across the container crushing the container sidewall and closure surfaces inward, facilitating the final folding and flattening of the container by the handle mechanism when fully rotated to its closed position.

BRIEF DESCRIPTION OF THE DRAWINGS

FIG. 1 is a perspective view of the preferred embodiment of applicant's container crusher.

FIG. 2 is a side cross sectional view of the preferred embodiment illustrating the initial engagement of a cylindrical crushable container by the pivot plate mechanism of the apparatus.

FIG. 3 is also a side cross sectional view of the preferred embodiment illustrating the engagement of a cylindrical crushable container by the handle mechanism and pivot plate mechanism of the apparatus, as the handle mechanism is rotated to its closed position.

FIG. 4 is a side cross sectional view illustrating the position of the handle mechanism, pivot plate mechanism and frame mechanism relative to the crushed container upon full rotation of the handle mechanism to its closed position.

FIG. 5 is a front view of a portion of the handle mechanism and pivot plate mechanism attached thereto.

DETAILED DESCRIPTION OF THE PREFERRED EMBODIMENTS

The preferred embodiment of a hand operated one-step apparatus for flattening and folding a crushable cylindrically shaped container having closure surfaces at both ends thereof, is generally indicated as 10 in FIGS. 1–4. The apparatus of the present invention includes a frame 12, a pivotally mounted handle 14 and a pivotally mounted pivot plate 16, the function of which are discussed in detail below.

Frame 12 has on a first end a retaining area 18 for retaining a crushable cylindrical container 26. Retaining area 18 in the preferred embodiment consists of a semicircular positioning depression or groove 19 for holding container 26, a stop 20 for securing in place one end of container 26 and a pivot plate guide 22. Groove 19 is aligned with the longitudinal axis of frame 12. It has a radius comparable to the radius of container 26.

As handle 14 is rotated from its fully opened position as shown in FIG. 2, to its closed position as shown in FIG. 4, it exerts a force upon container 26 which would tend to push container 26 along the longitudinal axis of frame 12. To counter this force and to assure that container 26 is retained in groove 19 throughout the entire crushing cycle, a stop 20 is positioned to prevent movement of container 26 as shown in FIGS. 2, 3 and 4.

Handle 14 is pivotally connected to the first end of frame 12 as shown by a hinge pin 28 in FIGS. 1–4 for rotation from an opened position as shown in FIG. 2, to a closed position generally parallel to frame 12 and displaced therefrom by a distance substantially less than the diameter of cylindrically shaped container 26 to be flattened and folded as shown in FIG. 4.

Pivot plate 16 is pivotally mounted at a fixed end 30 to handle 14, as shown by a hinge pin 32 in FIGS. 1–5, for rotation from a first position acutely angled with respect to the longitudinal axis of handle 14 as shown in FIG. 2, to a second position substantially flush with handle 14 when handle 14 is rotated to its closed position as shown in FIG. 4. A free end 40 of pivot plate 16, when pivot plate 16 is in its first position, is oriented to engage a side wall 44 of container 26, intermediate closure surfaces 38, 38 of container 26.

As handle 14 is rotated from its opened position to its closed position, pivot plate 16 is urged from its first position to its second position, collapsing side wall 44 inward as shown in FIG. 3.

To aid this collapse of side wall 44 by pivot plate 16, frame 12 in the preferred embodiment includes pivot plate guide 22. Pivot plate guide 22 is an arcuated support gap or depression, the longitudinal axis of which is perpendicularly disposed to the longitudinal axis of frame 12 and aligned vertically below pivot plate 16 in its first position. When container 26 is lying in positioning groove 19, part of container 26 spans the depression of pivot plate guide 22. Due to the lack of support underneath that part of container 26, container 26 offers less resistance to the crushing action of pivot plate 16, facilitating the folding of closure surfaces 38, 38 inward and the flattening of container 26 by handle 14 when fully rotated to its closed position, as shown in FIG. 4.

In its preferred embodiment, pivot plate 16 can be biased in its first position by the use of a spring bias, typically a coil spring 34, as shown in FIG. 5.

In its preferred embodiment, handle 14 also includes a semicircular depression 36 on its first end, formed for engaging the top edge of a cylindrical container closure surface 38, to enhance the flattening and folding of container 26 when handle 14 is rotated to its closed position.

The apparatus of the present invention is a hand operated, one-step apparatus for flattening and folding cylindrical crushable containers which leaves the vendor label readily discernible after the container is flattened. This vendor identification feature is an additional enhancement of the flattening capabilities of the apparatus, providing a superior means for flattening a crushable cylindrical container then shown by the prior art.

Although the present invention has been described with reference to the preferred embodiments, a person skilled in the art will recognize the changes that may be made in the form and detail without departing from the spirit and scope of the present invention as defined in the claims.

I claim:

1. A hand operated implement for flattening a crushable cylindrically shaped container having closure surfaces at both ends thereof, comprising:

frame means constructed and arranged for retaining a container on a first end thereof, the longitudinal axis of the container length being aligned with a longitudinal axis of the frame means;

handle means pivotally connected to the frame means adjacent the first end thereof, constructed and arranged for rotation from an open position angled at an acute angle to the longitudinal axis of the frame means, to a closed position generally parallel to the frame means and displaced therefrom by a distance substantially less than the diameter of the cylindrically shaped container to be crushed; and pivot plate means with a fixed end and a free end, pivotally mounted by its fixed end to the handle means for rotation from a first position, acutely angled with respect to the handle means and perpendicularly disposed with respect to the frame means when the handle means is in an opened position, to a second position substantially flush with the handle means when the handle means has been rotated to its closed position, the pivot plate means being constructed and arranged for engaging and crushing inward, with its free end, a side wall of a cylindrical container retained on the first end of the frame means, as the handle means is rotated from its opened position to its closed position, facilitating the folding of the container closure surfaces inward and the final flattening of the container by the handle means when fully rotated to its closed position.

2. The assembly of claim 1, further comprising spring means for biasing the pivot plate means in its first position.

3. The assembly of claim 2 wherein the spring means comprises a coil spring.

4. The assembly of claim 1 wherein the frame means further comprises a stop means at a longitudinally intermediate position thereon for securing in place one end of a container retained on the first end of the frame means.

5. The assembly of claim 4 further comprising a positioning means on the first end of the frame means, constructed and arranged to retain the container on the frame means while the container is flattened and folded.

6. The assembly of claim 5, wherein the positioning means is a semicircular depression of radius comparable to the radius of the container to be flattened and folded, sloping downward from the stop means to the first end of the frame means.

7. The assembly of claim 1 wherein the frame means further comprises a pivot plate guide means aligned vertically below the pivot plate means when in its first position, for enhancing the ease by which a cylindrical container retained on the first end of the frame means is collapsed by the pivot plate means, as the pivot plate means is urged from its first position to its second position by the rotation of the handle means.

8. The assembly of claim 1 wherein the pivot plate means is attached to the handle means at a longitudinally intermediate position thereon.

9. The assembly of claim 1 wherein the handle means further comprises a means for engagement with a container end to assist in folding the container end inward when the handle means is rotated from its opened position to its closed position.

10. The assembly of claim 9 wherein the means for engagement with a container end is a semicircular depression in the handle means formed to engage the top edge of a cylindrical container closure surface.

11. An improved hand operated implement for flattening and folding a crushable cylindrical container having closure surfaces at both ends thereof, comprising frame means for retaining a container on a first end thereof, handle means pivotally attached to the first end of said frame means for rotation from an opened position angled at an acute angle to the longitudinal axis of the frame means, to a closed position generally paralled to the frame means and displaced therefrom by a distance substantially less than the diameter of the container to be crushed, wherein the improvement comprises:

pivot plate means with a free end and fixed end, pivotally mounted by its fixed end to the handle means for rotation from a first position, angled at an acute angle with respect to the longitudinal axis of the handle means, and substantially perpendicular to the frame means when the handle means is in an opened position, to a second position substantially flush with the handle means when the handle means is in the closed position, the pivot plate means being constructed and arranged for engaging with its free end, the side wall of a cylindrical container retained on the first end of the frame means, as the handle means is rotated from its opened position to its closed position, facilitating the folding of the closure surface inward and the final flattening of the container by the handle means when fully rotated to its closed position.

* * * * *